United States Patent [19]

Blankenship

[11] Patent Number: 4,470,152

[45] Date of Patent: Sep. 4, 1984

[54] VALVE BAG WITH ALIGNMENT MEANS

[75] Inventor: Bernard F. Blankenship, Bay Village, Ohio

[73] Assignee: Basic Packaging Systems, Inc., Avon Lake, Ohio

[21] Appl. No.: 387,758

[22] Filed: Jun. 14, 1982

[51] Int. Cl.[3] ..... B65D 30/24

[52] U.S. Cl. ..... 383/37; 383/44; 383/45

[58] Field of Search ..... 229/62.5, 53, 69; 150/9; 53/450, 455; 383/37, 44, 57

[56] References Cited

U.S. PATENT DOCUMENTS

| | | | |
|---|---|---|---|
| 3,217,770 | 11/1965 | Garth | 229/53 |
| 3,337,117 | 8/1967 | Lehmacher et al. | 229/62.5 |
| 3,559,874 | 2/1971 | Titchenal | 229/69 |
| 3,791,573 | 2/1974 | Titchenal et al. | 229/69 |
| 3,833,166 | 9/1974 | Murray | 229/62.5 |
| 4,093,114 | 6/1978 | Lawes | 229/62.5 |

FOREIGN PATENT DOCUMENTS

| | | | |
|---|---|---|---|
| 709244 | 5/1965 | Canada | 229/62.5 |
| 930893 | 7/1963 | United Kingdom | 229/62.5 |

*Primary Examiner*—Stephen P. Garbe

*Attorney, Agent, or Firm*—Pearne, Gordon, Sessions, McCoy, Granger & Tilberry

[57] ABSTRACT

A valve bag and an interconnected series of valve bags is disclosed which have alignment means on the bag. This is shown as a continuous tunnel along a first edge of the interconnected bags for guidance into an automatic bag filling machine, for example, onto a mandrel threading the tunnel. Each bag has a valve formed by overlapping portions of panels of one wall of a bag. Parts of the overlapping portions are sealed together and other parts are left open between two valve side edge lines to form a valve from the overlapping material.

16 Claims, 8 Drawing Figures

VALVE BAG WITH ALIGNMENT MEANS

BACKGROUND OF THE INVENTION

Valve bags have been used for many years for packaging a wide variety of materials including cement and fertilizer. Valve bags are those having a small opening, smaller than open top bags wherein the entire top of the bag is open. Valve bags have an important advantage of easy filling through a valve structure, yet the valve may be self-closing after filling, due to the weight and volume of the filled contents. Also, valve bags are often used where the contents of the bag may be dusty and may prevent satisfactory and positive sealing of the bag. A number of prior designs for valve bags have been ones wherein the valve was a separate structure, often of a thin material, in order to provide the necessary antisift qualities to the valve after filling the bag. This was shown in U.S. Pat. Nos. 2,895,387; 3,394,871; and 3,221,789, and considerable cost and complexity were involved in the manufacture of the bags in order to insert this separate valve sleeve, position it properly, and fix it in position.

Practically all valve bags were produced as individual bags, the valve being manually inserted onto a filling spout, and the bag filled with the desired contents and then removed from the spout. Often the valve was tucked inside the bag by the operator so that the valve would be closed by the weight and bulk of the contents when the bag was laid flat. This required considerable labor cost in the filling of the bag because such manual handling for filling was slow, tedious, and often dangerous if the bags were being filled with toxic or hazardous material.

U.S. Pat. No. 3,746,246 showed a valve bag not requiring any separate supplemental valve sleeve to be inserted during its manufacture, the valve being constructed from the overlapping material of the bag itself. However, the bags still were separate, individual bags which required the manual operator to deftly manipulate the valve of the bag onto the filling spout during the filling operation and manually remove the bag from the spout upon completion of the filling, and hence this was also a slow filling operation, involving considerable labor expense. A similar construction was found in U.S. Pat. No. 3,833,166.

U.S. Pat. Nos. 3,559,874; 3,583,127; 3,699,746; 3,791,573; and 3,817,017 disclosed an interconnected chain of bags with a tunnel at the top edge for guidance of this chain of bags onto a mandrel of a bag-filling machine, with the bags being open-top bags for filling.

SUMMARY OF THE INVENTION

The problem to be solved, therefore, is how to construct an interconnected series of valve bags that may be fed automatically to a bag-filling machine, the bags being capable of being filled to an automatic machine to avoid the expense of manual labor and slowness of filling by manual manipulation of the valves of the bags onto the filling spout, yet avoiding the expense of a separate valve sleeve.

This problem is solved by an interconnected series of valve bags comprising, in combination, a first wall and a second wall connected together near all edges to form a substantially closed bag, said first wall being formed from first and second panels partially overlapping each other, at least one panel seal sealing between said first and second panels at the overlapping areas thereof with said panel seal terminating near a first valve side line transverse to a first edge of said bag, a second valve side line spaced from said first line and transverse to said first edge of a seal between said first and second panels at the overlapping areas thereof, a valve being defined between said two valve side lines and the unsealed portions therebetween of said overlapping first and second panels, the interior end of said valve being defined by a portion of said first panel and said valve having an openable exterior end defined by a portion of said second panel, the overlapping of said first and second panels defining a self-closing valve after filling the bag with the desired contents, alignment means on said bag adjacent said first edge and substantially continuous across said bag, and interconnecting means at least near said alignment means connecting each bag to an adjacent bag to form an interconnected series of bags with a substantially continuous alignment means along said series of bags for guidance of the series of bags along a reference line of a bag filling machine for sequential filling of the bag.

The problem is further solved by a valve bag comprising, in combination, a first wall and a second wall connected together near all edges to form a substantially closed bag, said first wall being formed from first and second panels partially overlapping each other, a tunnel formed adjacent a first edge of the bag by portions of said first and second walls, said tunnel being defined between said first edge and a tunnel seal spaced from and parallel to said first edge with the tunnel seal being between said first and second walls, a plurality of panel seals parallel to said first edge and sealing between said first and second panels at the overlapping areas of said panels with said plurality of seals terminating along a first valve side line perpendicular to said first edge, a second valve side line of a seal perpendicular to said first edge and sealing between said first and second panels at the overlapping areas of said panels, a valve being defined adjacent said overlapping areas between said two valve side lines and between unsealed portions of said first and second panels, the interior end of said valve being defined by an end of said first panel and the exterior opening of said valve being defined by a portion of said second panel, the overlapping of said first and second panels defining a self-closing valve after filling the bag with the desired contents, the portions of said first and second walls defining said tunnel being connected to adjacent bags in an interconnected series of bags to guide, orient, and align the bags movable serially onto a mandrel in a bag filling machine to have the tunnel slit near the first edge thereof for release from the mandrel either before or after filling the same with the desired contents.

Accordingly, an object of the invention is to provide a valve bag with an alignment means so that it may be aligned and fed to a bag filling machine.

Another object of the invention is to provide a tunnel to guide and orient a series of interconnected valve bags to permit the valve to be established in a correct position for automatic filling to eliminate manual handling and positioning of the bags at the fill spout.

Other objects and a fuller understanding of the invention may be had by referring to the following description and claims, taken in conjunction with the accompanying drawing.

DESCRIPTION OF THE PREFERRED EMBODIMENTS

Figure 1:
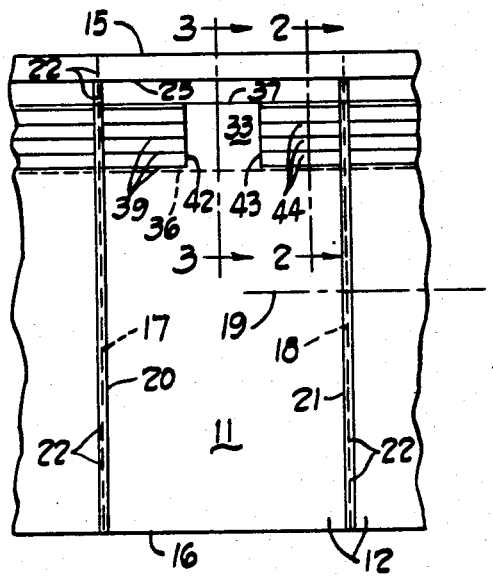
FIG. 1 is a plan view of a series of interconnected bags according to the invention.
Figure 2:
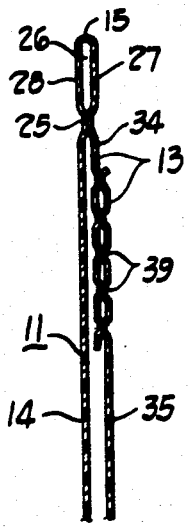
FIG. 2 is an enlarged, sectional view on the line 2—2 of FIG. 1.

FIGS. 1–4 illustrate a valve bag 11 in a series or chain 12 of interconnected bags 11. The bags are formed from a first wall 13 and a second wall 14. In the drawings, the thickness of the walls has been exaggerated in order to be able to show the hatching for sections. Means is provided to connect together the first and second walls near each of the edges to form a substantially closed bag. The bag walls are formed from some flexible material, and in one preferred embodiment this is a thermoplastic film such as polyethylene. Such film is heat-sealable and in FIGS. 1–4, the bag walls are shown as being connected together near each of the four edges. The valve bag 11 has a first edge 15, which also may be considered a top edge, and a second or bottom edge 16. The bag further has third and fourth edges 17 and 18, which are side or long edges of the bag 11. The bag walls are interconnected at the first and second edges 15 and 16, and in this preferred embodiment, the bags are made from a tube of film material, with the tube having a longitudinal axis 19. Since the bag 11 is made from the continuous tube, the first and second edges 15 and 16 are unitary with the bag walls 13 and 14, the tube from which the bag is made having been flattened in the view of FIGS. 1, 2, and 3. The first and second walls 13 and 14 are also interconnected at or near the side edges 17 and 18. In this preferred embodiment, they are sealed together on long seal lines 20 and 21, respectively, wherein the first wall 13 is sealed to the second wall 14. Conveniently, this may be by heat sealing by applied heat and pressure. The bag side edges 17 and 18 are along perforation lines made by cold perforations through both walls of the tube from which the bag 11 is made, and with lands 22 between the perforations along the perforation line which defines the edges 17 and 18, these lands interconnecting adjacent bags to make the series 12 of interconnected bags 11.

A tunnel seal 25 is shown substantially parallel to the first edge 15, and forms the lower edge of a tunnel 26, the sides of the tunnel 26 being formed by tunnel portions 27 and 28 of the first and second walls 13 and 14, respectively. This tunnel 26 may be referred to as an "alignment means" on the bag 11 to align the bag relative to a bag filling machine, as explained below. It will be noted in FIG. 1 that the side seals 20 and 21 extend completely from the bottom edge 16 up to the tunnel seal 25, but not any further, i.e., they do not cross the tunnel 26. The cold perforations at the bag edges 17 and 18, however, do extend completely through the tunnel, and preferably have one or more lands 22 thereat, the lands forming the interconnecting means between adjacent bags and permitting the establishment of a continuous tunnel through the series of bags.

Figure 3:
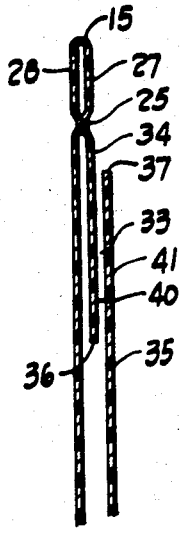
FIG. 3 is an enlarged, sectional view on the line 3—3 of FIG. 1.
Figure 4:
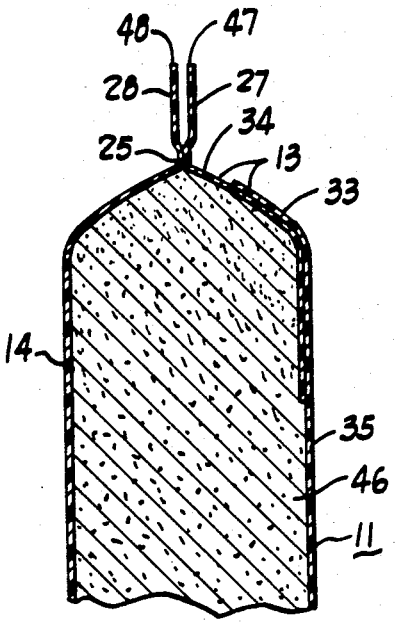
FIG. 4 is a view similar to FIG. 3, but after the bag has been filled and the valve closed.

The bag 11 has a valve 33 which is bounded by and formed by material of the bag itself. To accomplish this, the first wall 13 is formed from first and second panels 34 and 35, the second panel 35 having a portion 41 overlapping a portion 40 of the first panel 34 to a certain extent. The first panel 34 has a bottom edge 36 and the second panel 35 has a top edge 37. A plurality of panel seals 39 are provided between the overlapping portions 40 and 41, respectively, of the first and second panels 34 and 35. There is at least one such panel seal 39, and preferably one near the top edge 37 and one near the bottom edge 36 of the overlapping panels. These panel seals may be X-shaped or at an acute angle to the first edge 15; however, they are shown substantially parallel to the first edge 15 and extend from the side seal line 20 to a first valve side line 42. This valve side line 42 may be a discontinuous seal, but is shown as a continuous seal line between the overlapping portions 40 and 41. A second valve side line 43 between the overlapping panel portions 40 and 41 defines the other side of the valve 33. This second valve side line may be at the side seal 21 or, as shown, may be spaced therefrom by panel seals 44 between the overlapping panel portions 40 and 41. With this construction, it will be noted that the interior end of the valve 33 is defined by a portion of the first panel, namely, the end 36 of this first panel 34. The exterior opening of the valve 33 is defined by a portion of the second panel 35, namely, the top edge 37 of this second panel 35. FIG. 3 shows this valve 33 before the bag is filled and FIG. 4 is a similar view after the bag has been filled with appropriate contents 46. This FIG. 4 should be turned 90 degrees either right or left to show the contents when the bag has been laid on either the first or the second wall 13 or 14. In such case, the weight and bulk of the contents 46 close the valve 33 to make it a self-closing valve. FIG. 4, however, has been shown in a position with the valve 33 near the top of the bag in order to illustrate the correlation of FIG. 4 with that of FIGS. 2 and 3.

The series 12 of interconnected bags 11 has the special property of being capable of being filled in an automatic bag filling machine without the necessity for manually inserting the valve onto the spout of the machine, filling the bag, and then manually removing the bag from the spout. This is accomplished by utilizing the tunnel 26 as an alignment means to align the bag on some guide, such as a mandrel in a bag filling machine. This aligns and orients the bags so that they may be moved serially onto the mandrel. A cutter may be used to cut open the tunnel 26 near the first edge 15 to achieve two cut edges 47 and 48 so that the bag may be removed from the mandrel. This may be done either before or after filling.

Figure 5:
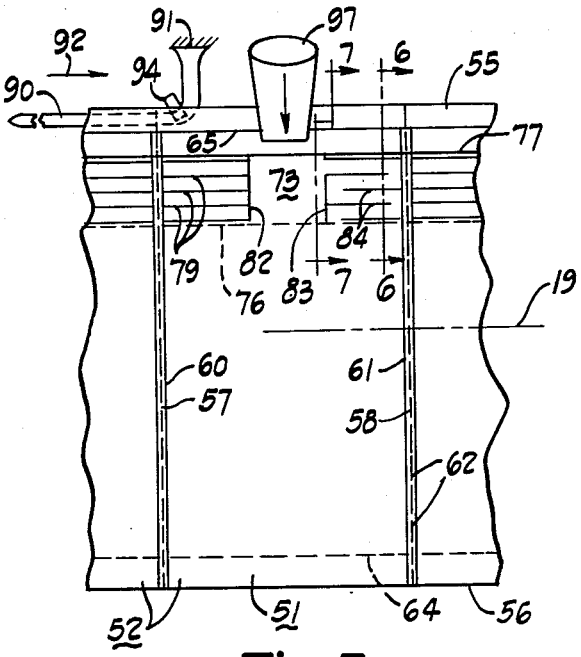
FIG. 5 is a plan view of a modified form of the interconnected series of bags.

FIGS. 5–8 show another modification of the bag, i.e., a valve bag 51 in an interconnected series 52 of bags 51. The bag 51 is quite similar to the bag 11, except where bag 11 is a pillow-style bag, with all four edges of the first wall directly connected to the edges of the second wall, the bag 51 of FIGS. 5–8 is a gusset-style bag. The bag 51 still has the first wall 53 and a second wall 54 interconnected at the edges. The bag 51 has a first or top edge 55 and a second or bottom edge 56. It also has third and fourth edges 57 and 58, respectively, along the two long sides thereof. The two long sides of the bag are defined by seal lines 60 and 61, and the third and fourth side edges 57 and 58 are defined by cold perforation lines with lands 62 therebetween, which lands form the interconnection means between the series 52 of bags 51. A top gusset 63 is provided at the top of the bag between the first and second walls to interconnect these walls, and a bottom gusset 64 is provided at the bottom of the bag, again to join the two walls 53 and 54. A tunnel seal 65 is again provided at the bottom of a tunnel 66, and this tunnel is formed by tunnel portions 67 and 68 of the first and second walls 53 and 54, respectively. Similar to the arrangement in FIG. 1, the seal lines 60 and 61, together with the gussets 64 and the tunnel seal 65, establish a substantially closed bag except for a valve 73. Again, this valve is provided between a first panel 74 and a second panel 75 of the first wall 53. The first panel has a bottom edge 76 and the second panel has a top edge 77. One or more panel seals 79 seal between overlapping panel portions, namely, a portion 80 of the first panel 74 and a portion 81 of the second panel 75. These panel seals 79 extend from the side seal 60 to a first valve side line 82, which again may be discontinuous but is shown as continuous. The other side of the valve 73 is defined by a second valve side line 83, which again may be at the second seal line 61 or may be spaced therefrom and utilize panel seals 84 between the overlapping portions 80 and 81. In the case of FIG. 5, these panel seals 84 are shown as a maze seal to prevent escape of the contents 86 of the bag but to act as a supplemental valve to aid the escape of air during filling of the bag with the contents 86.

Figure 6:
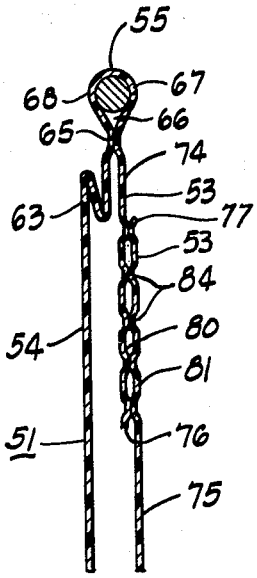
FIG. 6 is an enlarged, sectional view on line 6—6 of FIG. 5.
Figure 7:
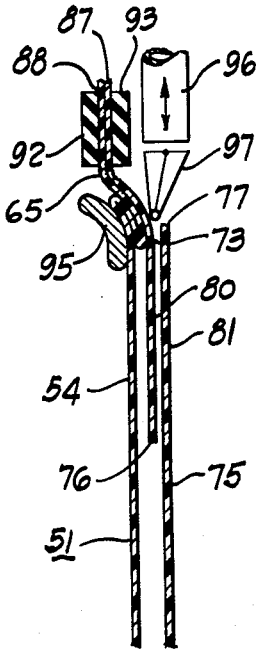
FIG. 7 is an enlarged, sectional view on line 7—7 of FIG. 6 and diagrammatically illustrating the method of filling.
Figure 8:
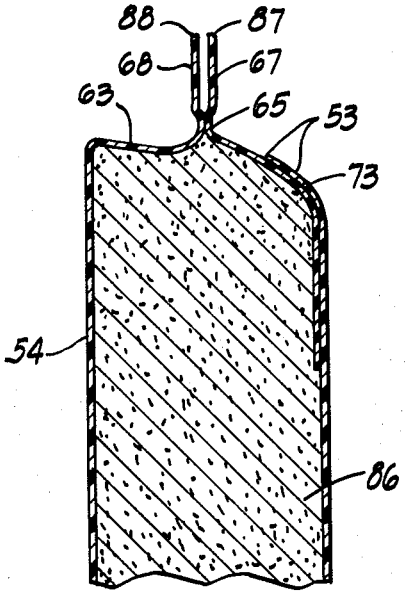
FIG. 8 is a view similar to FIG. 7, but with the bag filled and the valve closed.

FIGS. 6, 7, and 8 illustrate how the bags 51 may be filled on a bag filling machine which is only diagrammatically indicated. This same filling method may be used for the bags 11 of FIGS. 1–4. A mandrel 90 is indicated in FIGS. 5 and 6 supported from a cantilever mount 91. The arrow 92 indicates that the series of interconnected bags are moving from left to right, with the tunnel or alignment means 66 threaded onto the forward end of the mandrel 90 to guide, orient, and align the bags. Suitable means may be used to propel the bags, e.g., the bag top belts 92 and 93 shown in FIG. 7 may press against the opposite sides of the tunnel portions 67 and 68, and the propulsion of the belts moves the series of interconnected bags by frictional contact. The interconnection means between the bags provided by the lands 62 makes certain that all of the bags move at the same time and at the same speed. The bags may be moved periodically and then stopped for filling. As they are moved along the mandrel 90, a cutter 94 cuts the first edge 55 of the series of bags to form the cut edges 87 and 88. A deflector bar 95 may be utilized as an example, to deflect the upper portion of the bag immediately below the tunnel 66 toward the first wall 53. This will permit the valve 73 to be aligned vertically below a retractable filler tube 96 and also aligned beneath an optional retractable/collapsible outer spout 97 which may enter the exterior opening of the valve 73 at the top edge 77. This means the bag may be readily filled automatically with the contents 86. The filler tube 96 and outer spout 97 may be retracted by the machine and then the bag top belts 92 and 93 propel the filled bag further, optionally aided by a bottom conveyor belt to a point whereat the filled bag will break loose at the lands 62 from the next adjacent bag in the series 52 of bags 51. FIG. 8 should be turned 90 degrees from the position shown on the drawing so that it is resting on either the first or second wall 53 or 54, since this is the way the bag would be stacked on a pallet, for example, for shipment, and when laid on its side, the bulk and volume of the contents 86 close the valve 73 in the self-closing action.

It will be noted that the tunnel 26 or 66 acts as alignment means, which is on the bag and permits each bag to be aligned and guided on a bag filling machine. Further, because the tunnels 26 and 66 are continuous from one bag to the next, due to the interconnection at the lands 22 and 62, the interconnected series of bags 12 or 52 may be fed serially onto such mandrel 90. The tunnels in the series of bags are continuous because the side seals 20,21,60 and 61 stop at the tunnel seal 25 or 65, and do not extend across the tunnel. This alignment means permits use of the bags, especially the series of interconnected bags, in an automatic bag filling machine, so that it is not necessary for a person to manually place the valve of the bag on a filling spout, fill the bag, and then remove the bag from the filling spout. This alignment means is a physical alignment surface for contact with a bag filling machine, and more specifically for contact with the mandrel 90 of such bag filling machine. The alignment means is a portion of the walls of the bag which is substantially parallel to the first edge 15 or 55. In fact, it is the opposite surface of the bag wall at such first edge which physically contacts this mandrel.

In both embodiments of FIGS. 1 and 5, the tunnel seal 25 or 65 is continuous across the entire width of the bag 11 or 51, in a direction parallel to the first edge 15 or 55. In FIGS. 1–4, the bag walls 13 and 14 are directly joined together on all four edges to form a pillow bag, whereas in FIG. 5, the bag walls 53 and 54 are indirectly joined at the top and bottom by the gussets 63 and 64 to form a gusseted bag.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An interconnected series of valve bags for cooperation with a reference line in a bag filling machine comprising, in combination, a first wall and a second wall connected together near all edges to form a substantially closed bag;

said first wall being formed from first and second panels partially overlapping each other;

at least one panel seal sealing between said first and second panels at the overlapping areas thereof with said panel seal terminating near a first valve side line transverse to a first edge of said bag;

a second valve side line spaced from said first line and transverse to said first edge and including a seal between said first and second panels at the overlapping areas thereof;

a valve being defined between said two valve side lines and the unsealed portions therebetween of said overlapping first and second panels;

the interior end of said valve being defined by a portion of said first panel and said valve having an openable exterior end defined by a portion of said second panel, the overlapping of said first and second panels defining a self-closing valve after filling the bag with the desired contents;

interconnecting means at least near said first edge connecting each bag to an adjacent bag to form an interconnected series of bags;

means on said interconnected series of bags for alignment of said series of bags for guidance of the series of bags along a reference line of a bag filling machine; and said alignment means being capable of cooperation with the bag filling machine reference line after filling of the bag with the desired contents.

2. A series of valve bags as set forth in claim 1, wherein said alignment means is a physical alignment surface for contact with a bag filling machine reference line.

3. A series of valve bags as set forth in claim 1, wherein said alignment means is a portion of said walls substantially parallel to said first edge for sliding contact with a guide in a bag filling machine.

4. A series of valve bags as set forth in claim 1, wherein said alignment means is formed by said first edge.

5. A series of valve bags as set forth in claim 1, wherein said alignment means includes a tunnel on each bag substantially parallel to and near said first edge.

6. A series of valve bags as set forth in claim 5, wherein said tunnel is substantially continuous from one bag to the adjacent bag for serial threading of said bag tunnels by a mandrel guide in a bag filling machine.

7. A series of valve bags as set forth in claim 5, wherein said tunnel is formed adjacent a first edge of the bag and defined by tunnel portions of at least one of said walls and a tunnel seal spaced from said first edge.

8. A series of valve bags as set forth in claim 7, wherein said tunnel seal is continuous across the bag in a dimension parallel to said first edge.

9. An interconnected series of valve bags comprising, in combination, a first wall and a second wall connected together near all edges to form a substantially closed bag;

said first wall being formed from first and second panels partially overlapping each other;

a tunnel formed adjacent a first edge of the bag by first and second portions of at least one of said first and second walls;

said tunnel being defined between said first edge and a tunnel seal spaced from and parallel to said first edge with the tunnel seal being between said first and second tunnel portions;

a plurality of panel seals sealing between said first and second panels at the overlapping areas of said panels with said plurality of seals terminating along a first valve side line perpendicular to said first edge;

a second valve side line including a seal perpendicular to said first edge and sealing between said first and second panels at the overlapping areas of said panels;

a valve being defined adjacent said overlapping areas between said two valve side lines and between unsealed portions of said first and second panels;

the interior end of said valve being defined by an end of said first panel and the exterior end of said valve being defined by a portion of said second panel, the overlapping of said first and second panels defining a self-closing valve after filling the bag with the desired contents; and said tunnel portions being connected to adjacent bags to form an interconnected series of valve bags to guide, orient, and align the bags movable serially onto a mandrel in a bag filling machine to have the tunnel slittable near said first edge for release from the mandrel either before or after filling the same with the desired contents.

10. A valve bag as set forth in claim 9, wherein said tunnel seal is continuous across the bag in a dimension parallel to said first edge.

11. A valve bag as set forth in claim 9, wherein said bag walls are directly joined to form a pillow bag.

12. A valve bag as set forth in claim 9, wherein said connection between said first and second walls includes gussets near said first edge and the opposite edge.

13. A valve bag as set forth in claim 9, wherein said bag walls are formed from a sealable flexible film.

14. A valve bag as set forth in claim 9, wherein the exterior opening of said valve is spaced a greater distance from said first edge than said tunnel seal.

15. A valve bag as set forth in claim 9, wherein said first and second valve side lines are each spaced from the edges of said bag.

16. A valve bag as set forth in claim 9, wherein the exterior opening of said valve is spaced approximately twice the distance from said first edge as said tunnel seal to adapt the valve exterior opening for bag filling by lateral deflection of the bag between said tunnel seal and said exterior opening.

* * * * *